US005388598A

United States Patent [19]

Whitten

[11] Patent Number: 5,388,598

[45] Date of Patent: Feb. 14, 1995

[54] HAIR RESTRAINT

[76] Inventor: Billy F. Whitten, 3488 Troy Dr., Hollywood, Calif. 90068

[21] Appl. No.: 149,049

[22] Filed: Nov. 8, 1993

[51] Int. Cl.[6] ..... A45D 8/12

[52] U.S. Cl. ..... 132/275; 132/200; D28/41; 2/171

[58] Field of Search ..... 132/200, 212, 273, 275; D28/41, 39; 2/155, 156, 171

[56] References Cited

U.S. PATENT DOCUMENTS

| | | | |
|---|---|---|---|
| D. 254,273 | 2/1980 | Lawrence | D28/41 |
| D. 317,663 | 6/1991 | Calderon | D28/41 |
| 3,229,308 | 1/1966 | Jensen | D28/41 |
| 4,406,296 | 9/1983 | Wexler et al. | 132/275 |

*Primary Examiner*—John G. Weiss
*Attorney, Agent, or Firm*—Harris, Wallen MacDermott & Tinsley

[57] ABSTRACT

A hair restraint comprising a band having a decorative assembly at an end, the decorative assembly including a first wire with one or more decorations strung thereon, a crimp bead on the first wire at each end of the decorations, with a loop in an end of the first wire interengaging a loop in the end of the band, with the band loop fixed in place defining a closed loop, and with said the end of the first wire threaded back into one of the crimp beads and at least some of said decorations, and a second wire wrapped around the closed loop of said band with each of the crimp beads squeezed onto the first wire. A method of making such a hair restraint.

11 Claims, 2 Drawing Sheets

HAIR RESTRAINT

BACKGROUND OF THE INVENTION

This invention relates to hair restraints and in particular, to a new and improved hair restraint with decorations at each end.

Plain ribbons and similar bands are widely used as headbands wrapped around the wearer's head and as hair bands, sometimes wrapped around all the hair at the back or at the top, sometimes wrapped around the hair to form a ponytail, and sometimes wrapped around separate masses of hair to simulate braids. Conventional ribbons have been used for this purpose for many years. Also hair strings have been made of a thin piece of rawhide with beads at the ends held in place by knots.

It is an object of the present invention to provide a new and improved hair restraint which can serve the same purpose as the conventional ribbon or band while at the same time incorporating decorations which create distinctive looks. The hair restraint can be provided in a wide variety of styles and in different lengths to enhance any hair style and to use as a fashion accessory. The decorations may include one or more beads, shells, bells, figurines, cartoon characters and the like carried at the end of the band.

Hair restraints of this nature, while simple in appearance, are subject to active use and abuse. Accordingly, it is another object of the invention to provide such a hair restraint with a construction for the decorative objects which is strong and durable while at the same time not obtrusive and not likely to spoil the artistic appearance of the decorative assembly.

Other objects, advantages, features and results will more fully appear in the following description.

SUMMARY OF THE INVENTION

The presently preferred embodiment of the invention is a hair restraint comprising a band having a decorative assembly at each end, with each decorative assembly including a plurality of objects strung on a wire, with a crimp bead on the wire at each end of the objects, and with a loop in one end of the wire interengaging a loop in the end of the band, and with the end of the wire threaded back into one of the crimp beads and an object, and another wire wrapped around the closed loop of the band, with each of the crimp beads squeezed onto the first wire.

The invention also includes a method of making a hair restraint having a band with a decorative assembly at an end, including stringing one or more objects on a line to provide a decorative assembly with a crimp bead at each end, forming a loop at an end of the band, passing an end of the line through the band loop and then threading the end back into one of the crimp beads and an object, wrapping another line around the closed loop of the band, and compressing each of the crimp beads onto the first line.

DESCRIPTION OF THE PREFERRED EMBODIMENTS

Figure 2A:
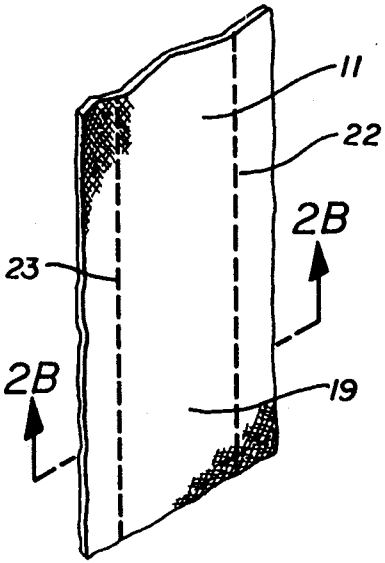
FIG. 2A is an enlarged partial view of one end of the band of the hair restraint of FIG. 1, showing a step in the assembly.
Figure 2B:
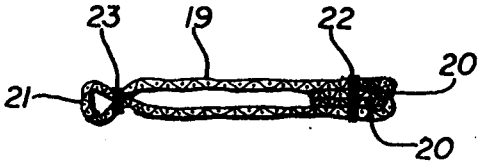
FIG. 2B is a sectional view taken alone the line 2B—2B of FIG. 2A.
Figure 1:
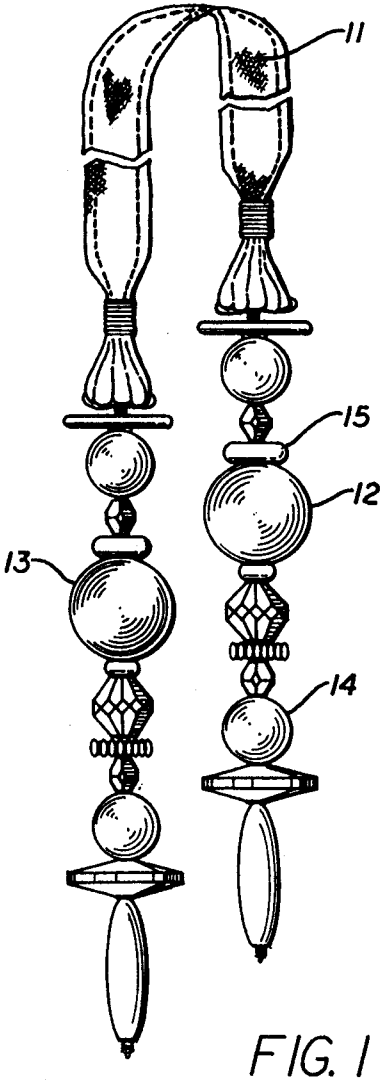
FIG. 1 is a plan view illustrating the presently preferred embodiment of the hair restraint of the invention.

A complete hair restraint is illustrated in FIG. 1, and includes a band 11 with decorative assemblies 12, 13 at each end of the band. A typical decorative assembly comprises beads 14 and/or shells 15 and/or figurines, cartoon characters, and/or other objects, with passages therethrough and strung on a line or wire 16, typically a copper wire. The band 11 is shown in greater detail in FIGS. 2 and 2A and typically includes a strip 19 of cloth or leather. Edges 20 of the strip 19 are folded over on themselves, and the strip is folded over on itself along its center line 21 to bring the folded over edges 20 into engagement. Then the folded over strip is stitched at 22 and at 23 to complete the band construction. While the preferred embodiment configuration for the band 11 is illustrated in FIGS. 2A and 2B and described above, it will be understood that other constructions for the band can be utilized.

Crimp beads 24, 25 are positioned on the wire 16 at each end of the decorative assembly 12. Typically the crimp bead is a short piece of tubing with a slit 28 preferably about halfway along the side, and made of a soft metal which permits compression of the bead. The compressed bead resembles a blob of solder. One such crimp bead is illustrated in greater detail in FIG. 3B.

Figure 3A:
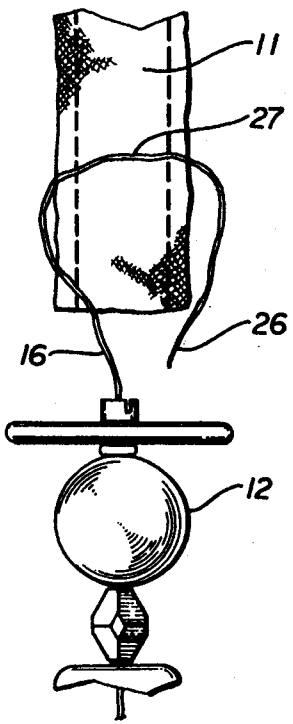
FIG. 3A is a view similar to that of FIG. 2 showing another step in the assembly.
Figure 3B:
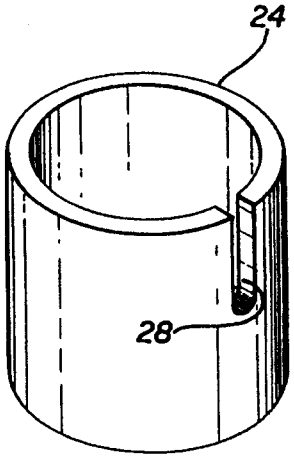
FIG. 3B is a detail of a crimp bead of FIG. 3A.
Figure 4:
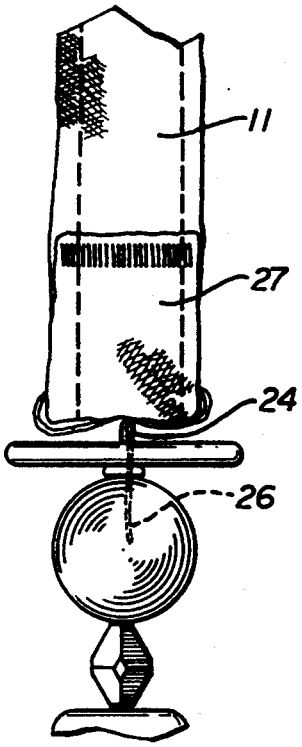
FIG. 4 is a view similar to that of FIG. 3A showing another step in the assembly.

An end 26 of the wire 16 is laid over an end 27 of the band 11, as seen in FIG. 3A. The end 27 of the band 11 is folded back onto the band to form a loop, with the end being fixed in place on the band, as by stitching. Similarly, the end 26 of the wire 16 is folded back to form a loop and is threaded through the crimp bead 24 and one or more of the objects of the decorative assembly. This provides the interengaging loops for the band and decorative assembly, as shown in FIG. 4. The bead 24 may be compressed now or later to clamp the end 26 in place.

Figure 5:
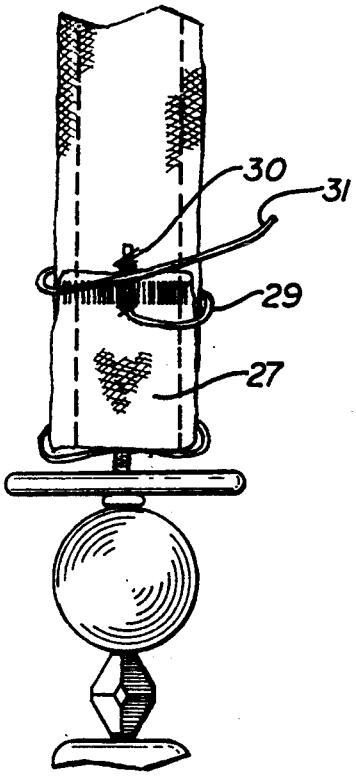
FIG. 5 is a view similar to that of FIG. 4 illustrating the first step in one method of wrapping the closed loop.
Figure 6:
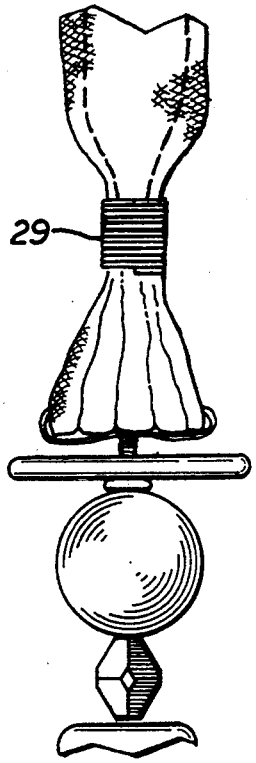
FIG. 6 is a view similar to that of FIG. 5 showing the completion of the wrapping of FIG. 5

Next another line or wire 29 is wrapped around the loop of the band, overlying the end of the band. In the construction illustrated in FIGS. 5 and 6, one end 30 of the wire 29 is laid on the band over the end 27 along the center line of the band. Then the free end 31 is helically wrapped over the end 30 of the wire, the end 27 of the band, and the loop of the band. The tightly wrapped wire 29 compresses the band into a generally cylindrical shape, as seen in FIG. 6.

Figure 7:
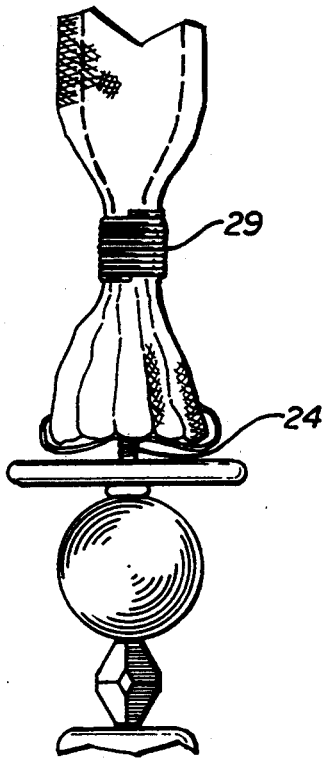
FIG. 7 is a view similar to that of FIG. 5 showing an alternative form of the wrapping.
Figure 8:
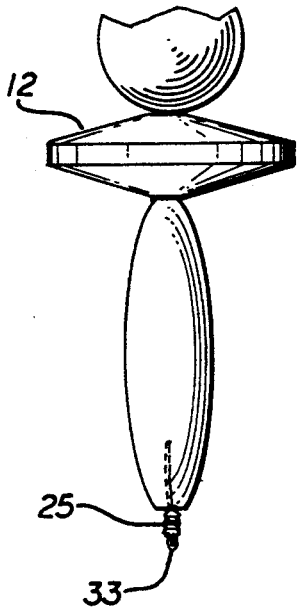
FIG. 8 is a view similar to that of FIG. 7 illustrating the compression of the crimp beads to complete the hair restraint.

An alternative method of wrapping is shown in FIG. 7, with the wire 29 being helically wrapped around the loop and end of the band, with each end of the wire cut off at the wrapping.

The other end 33 of the line 16 is threaded back through the crimp bead 25 and one or more of the objects of the decorative assembly, after which the crimp bead 25 is compressed to lock the objects on the wire. This compression step may be performed at any time after the objects are strung on the line.

While a plurality of objects are shown for each decorative assembly, it is realized that only a single object is necessary. Also, the crimp beads can be separate from the objects as shown in the drawing figures, but also could be formed integral with an object. While a decorative assembly is shown at each end of the band, the hair restraint of the invention can be produced with a decorative assembly only at one end of the band if desired. With the construction of the invention the hair restraint is completely washable and retains its shape after washing.

I claim:

1. A hair restraint comprising a band having a decorative assembly at an end, the decorative assembly comprising in combination:

a first wire having a first end and a second end;

a decoration including at .least one object with a passage therethrough and strung on said first wire;

a crimp bead on said first wire at each end of said decoration;

with a loop in said first end of said first wire interengaging a loop in the end of said band, with said band loop fixed in place defining a closed loop in said band; and with said first end of said first wire threaded back into one of said crimp beads and at least some of said decoration; and a second wire wrapped around said closed loop of said band;

with each of said crimp beads squeezed onto said first wire.

2. A hair restraint as defined in claim 1 with said second end of said first wire threaded back into the other of said crimp beads and an object.

3. A hair restraint as defined in claim 1 with said second wire helically wrapped on said closed loop of said band providing a substantially cylindrical shape.

4. A hair restraint as defined in claim 1 with one end of said second wire aligned with said band and overlying the end of said band, and with said second wire helically wrapped on said closed loop of said band and said one end of said second wire providing a substantially cylindrical shape.

5. A hair restraint as defined in claim 1 wherein said band is formed of a strip with parallel folded over edges and with said strip folded over along the strip center line bringing said folded over edges into engagement, with a first line of stitching adjacent said center line and a second line of stitching along said engaged folded over edges.

6. A hair restraint as defined in claim 1 including a decorative assembly at each end of said band, and wherein said decoration includes a plurality of decorative objects strung on said first wire.

7. A hair restraint comprising a band having a decorative assembly at an end, the decorative assembly comprising in combination:

a first line having a first end and a second end;

at least one decorative object with a passage therethrough and strung on said first line;

a crimp bead on said first line at each end thereof;

with a loop in said first end of said first line interengaging a loop in the end of said band, with said band loop fixed in place defining a closed loop in said band; and with said first end of said first line threaded back into one of said crimp beads; and a second line wrapped around said closed loop of said band;

with each of said crimp beads squeezed onto said first line.

8. A method of making a hair restraint having a band with a decorative assembly at each end, including steps of:

stringing a plurality of objects on a first wire to provide a decorative assembly, with a crimp bead at each end of each decorative assembly;

forming a loop at each end of the band;

passing an end of the first wire through a band loop and then threading the end back into one of the crimp beads and at least some of the objects;

wrapping a second wire around the closed loop of the band;

threading the other end of the first wire back into the other of the crimp beads and at least some of the object; and compressing each of the crimp beads onto the first line.

9. The method as defined in claim 8 including laying an end of said second wire coaxially on said band overlying the end of the band and a portion of the loop, and helically wrapping the second wire over the wire end and the portion of the band loop.

10. A method of making a hair restraint having a band with a decorative assembly at an end, including the steps of:

stringing a decoration on a first line to provide a decorative assembly, and a crimp bead on the first line at each end of the decorative assembly;

forming a loop at an end of the band;

passing an end of the first line through the band loop and then threading the end back into one of the crimp beads;

wrapping a second line around the closed loop of the band; and compressing each of the crimp beads onto the first line.

11. A method as defined in claim 10 including threading the other end of the first line back into the other of the crimp beads.

* * * * *